US007387268B2

(12) United States Patent
Dahle et al.

(10) Patent No.: US 7,387,268 B2
(45) Date of Patent: Jun. 17, 2008

(54) DOCUMENT DESTROYER WITH INDIVIDUAL SHEET FEEDING FOR STACKED SHEET MATERIAL

(75) Inventors: Gerd Dahle, Coburg (DE); Jochen Butz, Weidhausen (DE)

(73) Assignee: Dahle Büerotechnik GmbH, Coburg (DE)

( * ) Notice: Subject to any disclaimer, the term of this patent is extended or adjusted under 35 U.S.C. 154(b) by 862 days.

(21) Appl. No.: 10/898,378

(22) Filed: Jul. 23, 2004
(Under 37 CFR 1.47)

(65) Prior Publication Data

US 2007/0181722 A1 Aug. 9, 2007

Related U.S. Application Data

(63) Continuation of application No. PCT/EP03/00658, filed on Jan. 23, 2003.

(30) Foreign Application Priority Data

Jan. 25, 2002 (DE) ..... 102 03 126

(51) Int. Cl.
*B02C 1/08* (2006.01)

(52) U.S. Cl. ..... 241/224; 241/236

(58) Field of Classification Search ..... 241/236, 241/224

See application file for complete search history.

(56) References Cited

U.S. PATENT DOCUMENTS 5,009,410 A * 4/1991 Fujii et al. ..... 271/127
5,383,655 A * 1/1995 Hayakawa et al. ..... 271/10.01
5,772,129 A * 6/1998 Nishio et al. ..... 241/30

FOREIGN PATENT DOCUMENTS

JP 05146699 6/1993
WO 01/54820 A1 8/2001

* cited by examiner

*Primary Examiner*—Bena Miller
(74) *Attorney, Agent, or Firm*—Laurence A. Greenberg; Werner H. Stemer; Ralph E. Locher

(57) ABSTRACT

A method for destroying stacked sheets according to which the sheets are mechanically individualized, grasped and cut. To this end, the down-most individual sheet in the stack is grasped in its center section from below, is folded and removed from the stack as a part preceding the stack in the direction of conveyance and is then supplied to a cutting tool with the fold of its center section first.

17 Claims, 13 Drawing Sheets

DOCUMENT DESTROYER WITH INDIVIDUAL SHEET FEEDING FOR STACKED SHEET MATERIAL

CROSS-REFERENCE TO RELATED APPLICATION

This application is a continuation, under 35 U.S.C. § 120, of copending international application No. PCT/EP03/00658, filed Jan. 23, 2003, which designated the United States; this application also claims the priority, under 35 U.S.C. § 119, of German patent application No. 102 03 126.6, filed Jan. 25, 2002; the prior applications are herewith incorporated by reference in their entirety.

BACKGROUND OF THE INVENTION

Field of the Invention

The invention relates to a document destroyer, namely an apparatus for destroying stacked sheet material substantially sheet by sheet using a cutting unit. Such a unit is disclosed in International Patent Disclosure No. PCT WO 01/54820 A1.

In the case of the known document destroyer, the sheet material is fed from a sheet stack to its cutting unit—if appropriate also for cross cutting—not by hand, in more or less separated sheet form, but automatically in a motor-driven manner. The known document destroyer uses preferably a continuously circulating friction-wheel drive to execute the drawing-off action automatically sheet by sheet from the underside of the sheet stack, to fold the sheet centrally and to feed it, with the fold in front, to the cutting unit located beneath the support for the sheet-material stack.

The separated feeding of sheets to the cutting unit makes it possible, even for a high sheet-destroying capacity, to use a straightforward cutting unit of known conventional document destroyers. The operations of drawing off the sheet and folding it and feeding it to the cutting unit can be realized mechanically in a straightforward manner by a continuously circulating friction-type drive. Although the operation of destroying the sheet-material stack sheet by sheet takes up a certain amount of time, once the sheet stack has been fed, it takes place completely automatically, without manual intervention, with comparatively low outlay in structural terms.

A significant part of the transporting configuration, which grips the individual sheets from the underside of the sheet-material stack and draws them off, is formed by two carry-along rollers that are driven in opposite directions at a constant speed of circulation. They grip the bearing surface of the sheet at the bottom of the sheet-material stack by way of their circumference, which is provided as a friction coating or with gripping teeth, and push this sheet, from both sides, in the direction of the sheet center. The sheet center is thus deflected in the direction of the through-passage between the two carry-along rollers. The crease or fold vertex which is produced by the deflection is fed between the two carry-along rollers, in the downward direction away from the stack, to the cutting unit of a conventional configuration, which is located beneath, by way of the pushing action exerted by the friction rollers. At the cutting unit, the leading fold vertex is gripped by the cutting disks of the cutting unit. The folded sheet here is drawn through the cutting unit, by the cutting disks, with its doubled sheet sides located one upon the other.

In order to ensure, during the operation of gripping the sheet which is located at the bottom of the stack in each case, that the crease or fold vertex, which forms in the sheet center when the sheet halves are guided together, is deflected downward away from the stack in the direction of the cutting unit, the known document destroyer contains a pressure-exerting apparatus which acts on the sheet-material stack centrally from above. The pressure-exerting apparatus is positioned above the interspace above the two carry-along rollers and forces the sheet-material stack downward there. Its main task is to bring about, in the individual sheet, drawn off on the underside of the sheet-material stack, the formation of a crease or fold vertex which is produced in the downward direction, toward the cutting unit, and away from the sheet-material stack.

SUMMARY OF THE INVENTION

It is accordingly an object of the invention to provide a document destroyer with individual sheet feeding for stacked sheet material which overcomes the above-mentioned disadvantages of the prior art devices of this general type. The pressure-exerting apparatus which, during the operation of drawing off the sheet located at the bottom of the stack, causes a crease or fold vertex which is oriented downward in the direction of the cutting unit to be generated even more reliably and efficiently, which screens the drawing-off configuration in the outward direction, in order to avoid any risk of injury, and which allows straightforward operation with good operational reliability.

With the foregoing and other objects in view there is provided, in accordance with the invention, an apparatus for destroying stacked sheet material substantially sheet by sheet. The apparatus includes a support surface for receiving a sheet stack. The support surface has a slot-shaped through-opening formed therein positioned approximately centrally in the support surface and intended for removing a sheet drawn off from an underside of the sheet stack. A conveying configuration is provided for drawing off the sheet material from the support surface and for feeding the sheet material to a cutting unit. A support chamber houses the sheet stack. Bearing bases flank the support chamber on both sides of the slot-shaped through-opening. Closure elements having pivot pins pivotably mount the closure elements on the bearing bases. The pivot pins are disposed substantially parallel to a slot direction of the slot shaped through-opening and flank the support chamber on both sides. The closure elements cover the support chamber from above during a sheet-destroying operation and, for this purpose, the closure elements can each be pivoted, in a manner of covering halves, above the pivot pins, from an open position, in which the support chamber is open, into a closed position, in which the support chamber is substantially covered, and vice versa. Pressure-exerting elements are positioned between the support surface and the closure elements and press the sheet stack against the support surface. Each of the pressure-exerting elements is articulated on one of the bearing bases, in a manner of a connecting rod of a crank-rocker linkage. Displacement links are provided and each is connected between a respective one of the pressure-exerting elements and a respective one of the bearing bases. Control links are provided and each is connected between a respective one of the pressure-exerting elements and a respective one of the bearing bases. Articulation elements are provided and each functions as a connecting link acting on a respective one of the displacement links and connected to a respective one of the closure elements, such that, by virtue of the respective closure element being pivoted open or closed, the respective pressure-exerting element being pivoted along into a pressure-exerting position or open position corresponding to the open position of the respective closure element.

The solution makes it possible for the fed sheet-material stack to be covered in the outer direction, during the sheet-destroying operation, by closure elements that can be operated by manual pivoting. The closure elements screen the sheet-material stack in the direction of the charging side, that is to say the upward direction, in the manner of cover halves that can be pivoted in the direction of one another. Furthermore, both in their closed position and in their open or loading position and when they are transferred manually into their open position and into their closed position, they control the positioning of the pressure-exerting elements. During their opening movement, it is not just the case that the closure elements themselves free the unobstructed access to the sheet-stack support of the document destroyer. Rather, during their opening movement, they also remove the pressure-exerting elements from the access path to the sheet-stack support. This is made possible by the particular mechanism-based articulation of the pressure-exerting elements. When the closure elements are pivoted open, the pressure-exerting elements are automatically removed from the support chamber and thus cannot form an obstruction during the loading operation.

When the closure elements are transferred into their closed position, the closure elements move the pressure-exerting elements in dependence on the height of the sheet stack that is to be destroyed, into a suitable pressure-exerting position. Moreover, once the closed position has been reached, they control the contact pressure of the pressure-exerting elements on the top side of the sheet-material stack. This control is brought about in a manner that ensures optimum contact pressure and pressure-exerting positioning of the pressure-exerting elements automatically in each case without separate drives acting from the outside.

Other features which are considered as characteristic for the invention are set forth in the appended claims.

Although the invention is illustrated and described herein as embodied in a document destroyer with individual sheet feeding for stacked sheet material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
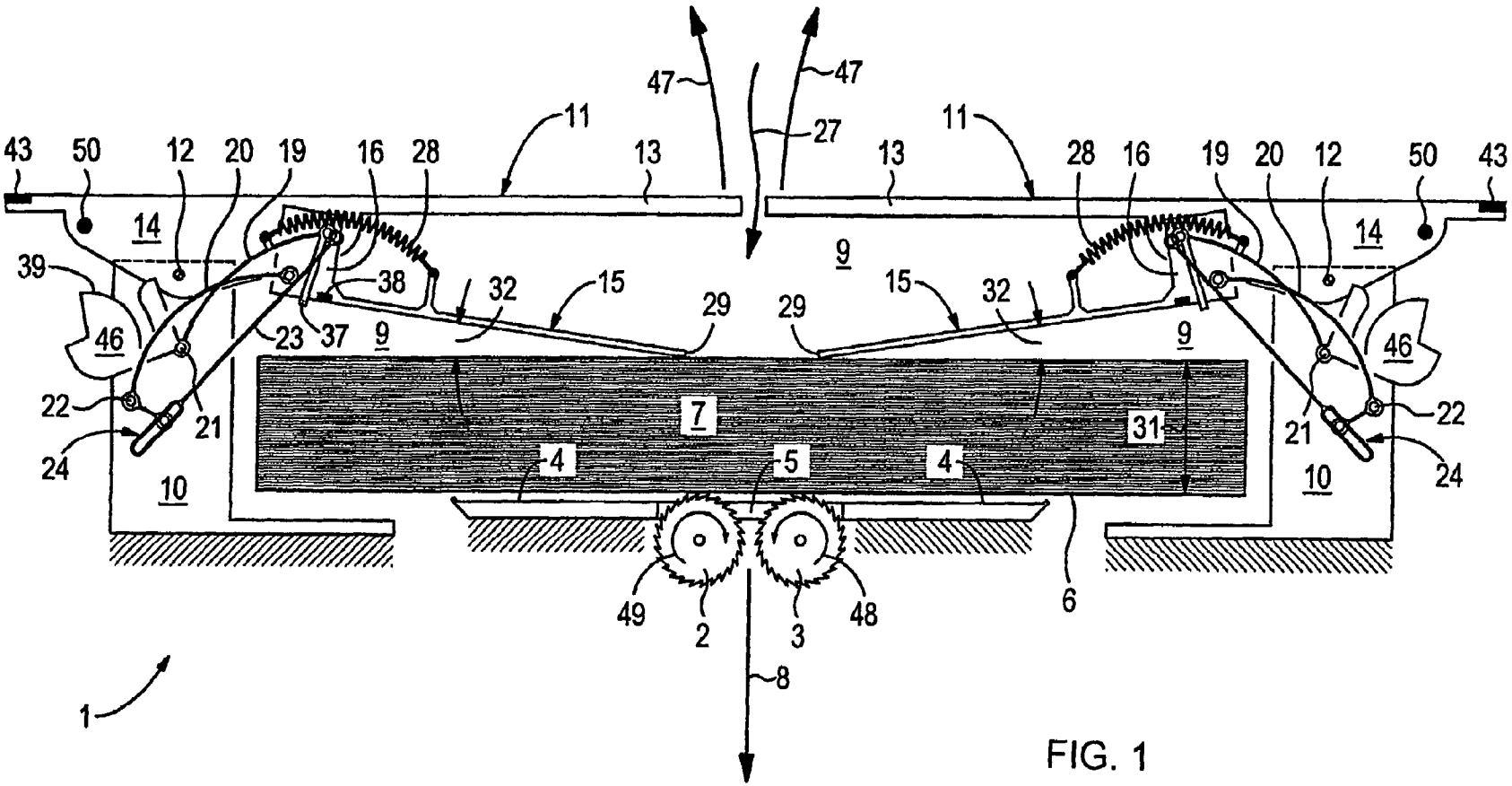
FIG. 1 is a diagrammatic, longitudinal section view through an apparatus according to the invention at the beginning of an operating cycle for destroying a sheet stack.
Figure 2:
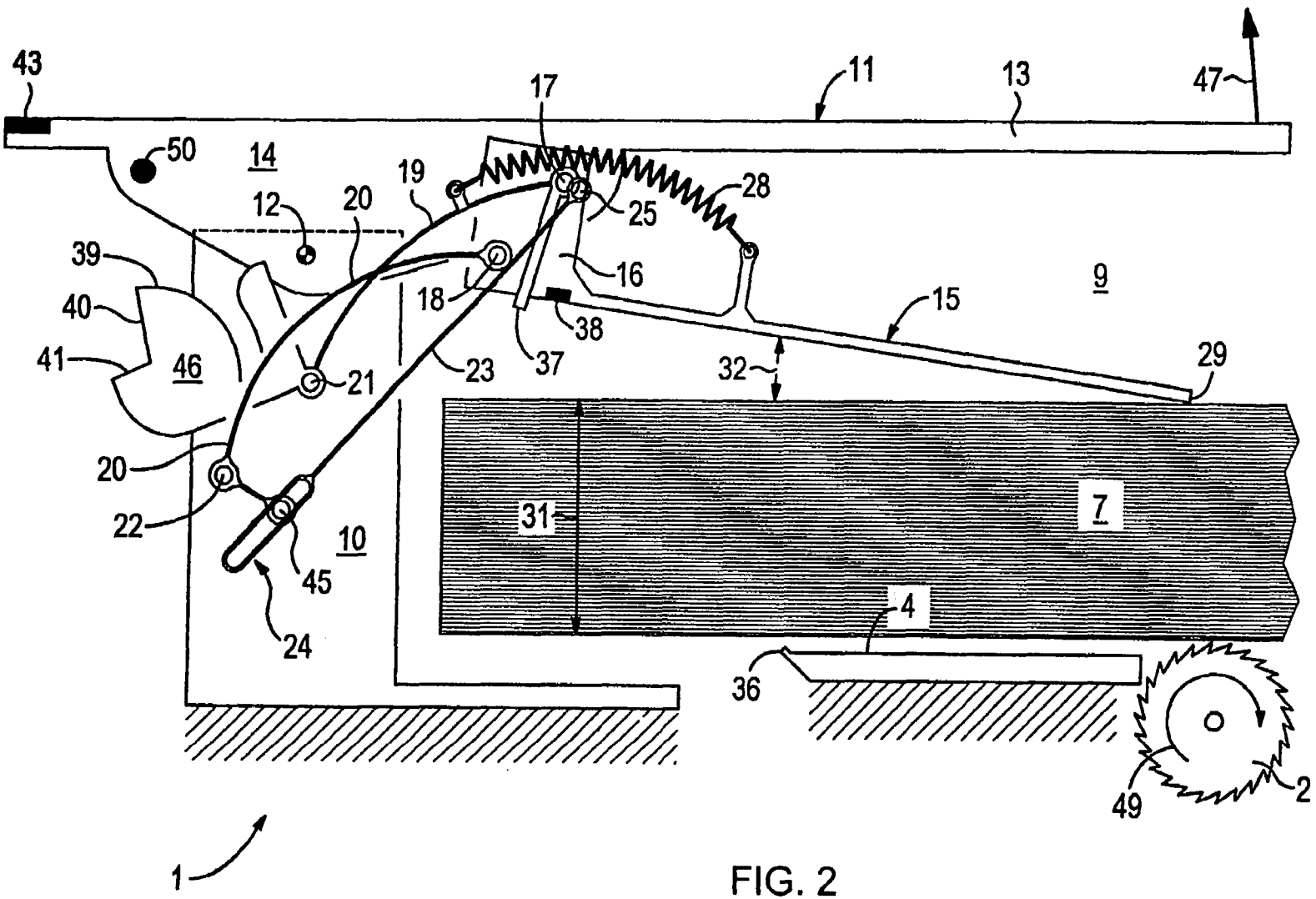
FIG. 2 is a diagrammatic, enlarged, left-hand sectional view of the apparatus according to FIG. 1, the right-hand part of which can be imagined analogously in mirror-inverted form (see FIG. 1)

Referring now to the figures of the drawing in detail and first, particularly, to FIG. 1 thereof, there is shown a destroyer 1 which contains a support surface 4 with a through-opening 5 positioned centrally in the support surface 4. The through-opening serves for the removal of individual sheets which are drawn off from an underside 6 of the sheet-material stack 7 by the two carry-along rollers 2, 3. The carry-along rollers 2, 3 are located partly within the through-opening 5 and have their outer circumference projecting at the top beyond the support surface 4 in the direction of the sheet stack 7. They are driven continuously in circulation in the directions of rotation 48, 49, which run counter to one another.

By means of their circumference, which provides for the action of friction or is covered by carry-along elements, the rollers 2, 3 grip the respectively lowermost sheet in the stack 7 on its underside 6 and guide its gripped sheet halves together in an inward direction. This produces a fold vertex that is inclined downward in a feeding direction 8 to the cutting unit. The doubled sheet is removed in the feeding direction 8 with the fold vertex in front, as is described in more detail in the generically determinative prior art. The carry-along rollers 2, 3 thus do not just draw off the bottom sheet of the sheet stack 7 from the support surface 4; rather, they also feed it in the described manner, as the conveying configuration, to a non-illustrated cutting unit located beneath the support surface 4.

A support chamber 9 for the sheet stack 7, extends into a region above the support surface 4, and is flanked on both sides of the through-opening 5 by in each case one bearing base 10 for pivotably mounting in each case one closure element 11. For the sake of simplicity, a closure element 11 is also referred to herein below as a "closure cover". The closure elements 11 are mounted on the respective bearing base 10 such that they can be pivoted about the pivot pin 12. In their closed position (FIGS. 1 to 5), the closure elements 11 close the support chamber 9 in the upward direction. The support chamber 9 is not accessible during the sheet-destroying operation.

In the case of the document destroyer according to the invention, the two bearing bases 10 flanking the support chamber 9 are each assigned a closure element 11 in a pivotable manner about the respective pivot pin 12. The closure elements 11 thus have their covering extension arms 13, which function as covers, and project toward one another from their pivot-bearing ends 14 (FIG. 1). The pivot pins 12 flank the support chamber 9 for the sheet stack 7 on both sides. They run parallel to the slot direction of the through-opening 5 in the support surface 4, the slot direction not being illustrated but extending perpendicularly to the plane of FIG. 1.

The document destroyer contains pressure-exerting elements 15 positioned between its support surface 4 and the closure elements 11. The pressure-exerting elements 15 are in the form of pressure-exerting plates that extend, perpendicularly to the direction of the figures of the drawing, over more or less most of the widthwise extent of the closure elements 11. The pressure-exerting elements 15 force the sheet stack 7 in the direction of the support surface 4. Those sides of the two pressure-exerting elements 15 which are directed toward the respective bearing base 10 are configured as base-like articulation-carrier holders 16. Each articulation-carrier holder 16 contains pivot pins 17, 18 (FIG. 2) which run perpendicularly to the planes of the drawing and are intended for bearing a control link 19 and a displacement link 20—both in a pivotable manner in the plane of the figures.

The two pivot pins 17, 18 of each articulation-carrier holder 16 only bear those ends of the control link 19 and of the displacement link 20 that project into the support chamber 9. The base (bearing base 10) ends of the control link 19 and of the displacement link 20 (FIGS. 2 to 9) in each case are mounted on the bearing base 10 such that they can be pivoted about the respective pivot pins 21 and 22 running perpendicularly to the plane of the figures. While the housing-mounted bearing base 10 of the document destroyer is positioned in a stationary manner, the control link 19 and the displacement link 20 form the two elements of the articulation-carrier holder 16, which function as a connecting rod of a crank-rocker linkage, and of the pressure-exerting element 15 assigned thereto. The pressure-exerting element 15 is thus secured on the articulation-carrier holder 16 by an articulation mechanism or coupling mechanism in the manner of a crank-rocker linkage.

Figure 3:
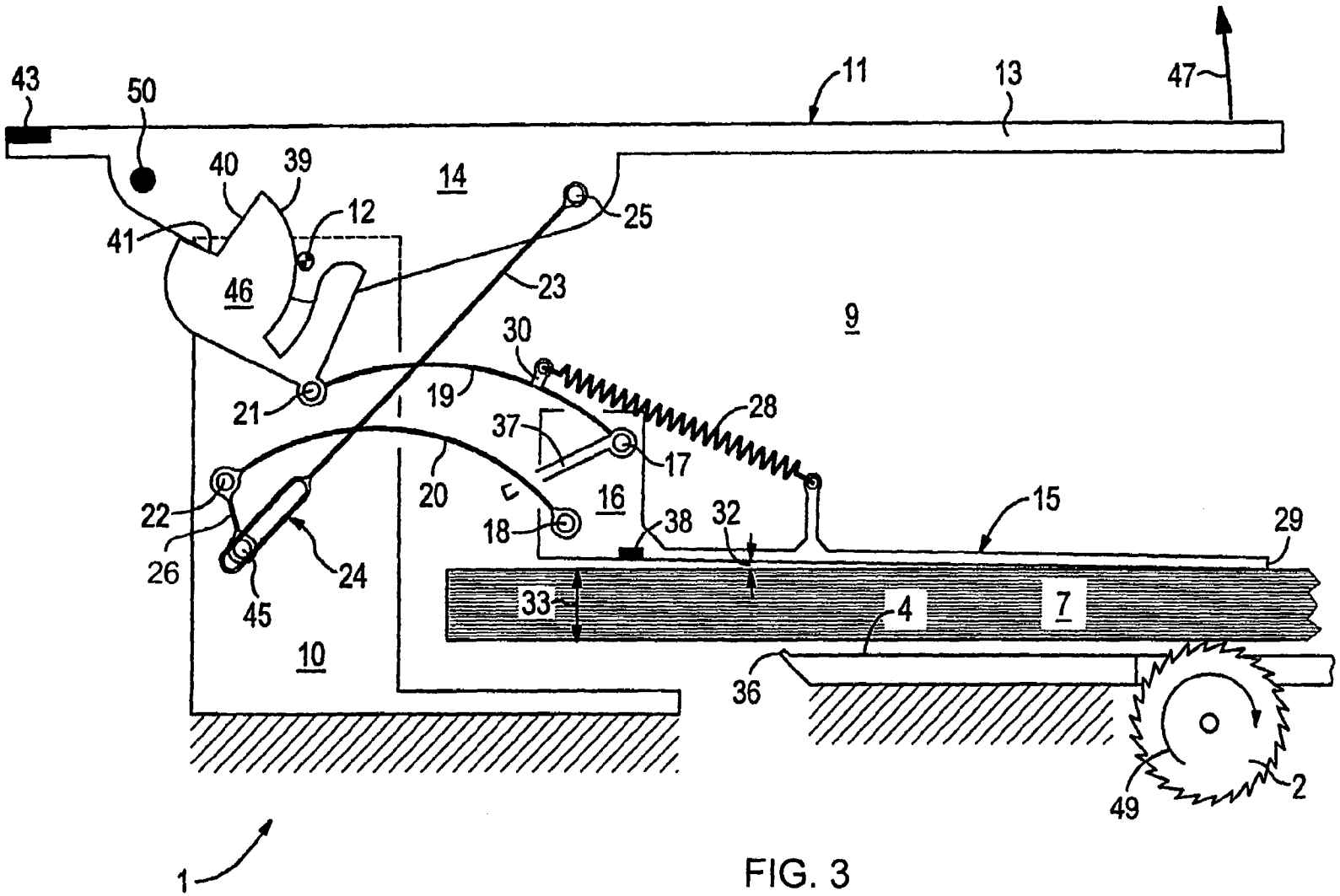
FIG. 3 is a sectional view analogous to FIG. 2 with the height of the sheet stack already markedly reduced, e.g. once more than half the stack illustrated in FIGS. 1 and 2 has been destroyed.

A connecting link 23 between the closure element 11 and the associated displacement link 20 contains a rotary/pushing-action articulation 24 at its bearing-base-like end. The top end of the connecting link 23, this end being directed away from the rotary/pushing-action articulation 24, is connected to the closure element 11 such that it can be pivoted about the pivot pin 25 (FIG. 3). The pivot pin 25, like all the other pivot pins, extends perpendicularly to the planes of the drawing.

The pivoting connection between the connecting link 23 and the displacement link 20 acts on an extension spur 26 of the displacement link 20, the spur 26 functions as a lever. The extension spur 26 projects in the manner of a stublike-lever arm beyond the base-side (bearing base 10) articulation pin 22 of the displacement link 20 and thus forms a two-armed lever with the displacement link 20.

The rotary/pushing-action articulation 24 of the connecting link 23 with an articulation 45 as a rotary-articulation part, engaging at the free end of the extension spur 26, acts on the displacement link 20 as a lever that is active about the articulation 45. The pushing-action direction of the rotary/pushing-action articulation 24 runs in the longitudinal direction of the connecting link 23.

The bearing bases 10 are integrated or fixed in side walls of a feed shaft 27 to the support surface 4.

Each pressure-exerting element 15 has its projecting end 29, which is directed away from its articulation-carrier holder 16 and projects into the support chamber 9, extending as far as the through-opening 5 for the drawn-off sheet material.

A tension spring 28 is active between the control link 19 and pressure-exerting element 15. The tension spring 28 forces the pressure-exerting element 15 in the direction away from where it bears on the sheet stack 7. It thus tries, to a certain extent, to raise the pressure-exerting element 15 upwards by way of its free, projecting end 29. In conjunction with the four-bar mechanism 10, 19, 16, 20, the tension spring 28 provides additional pressure in the downward direction on the paper stack 7 for the overall movement of the pressure-exerting element 15.

The tension spring 28 has its end that is directed toward the control link 19 fixed on the control link 19 approximately centrally between the articulation ends 17, 21 thereof. The fixing takes place on a fixing protrusion 30 which projects in the direction of the closure element 11.

Figure 4:
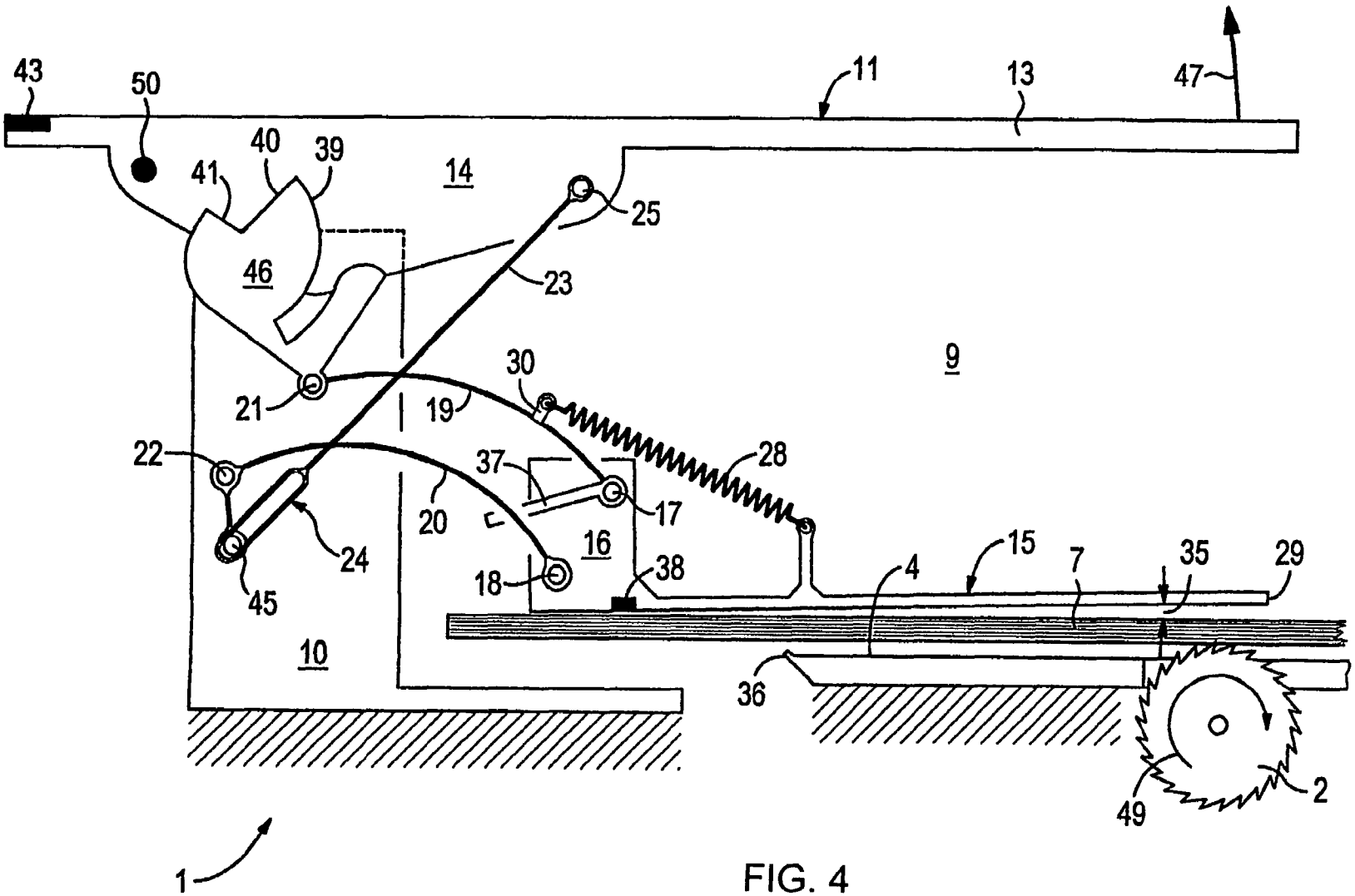
FIG. 4 is a sectional view of an illustration analogous to FIG. 3 with the stack height processed further to just a few sheets.

In the case of a large stack thickness 31 (FIGS. 1 and 2) with a corresponding vertical spacing from the support surface 4, the pressure-exerting element 15 has its projecting end 29 inclined in the direction of the through-opening 5 of the support surface 4 (angle of inclination 32). The magnitude of the angle of inclination 32 decreases along with the stack thickness until, in the case of an average stack thickness 33, a more or less parallel position is reached. In the case of a small spacing 34 close to or equal to a stack height of zero, the pressure-exerting element 15 has its articulation carrier holder 16 resting on the sheet stack 7. In this position, the respective pressure-exerting element 15 is inclined in a state in which it slopes up in the direction of the through-opening 5 (angle of inclination 35; FIG. 4), with the result that its projecting end 29 no longer exerts any pressure in the direction of the support surface 4. In the end position (FIG. 5), however, the pressure-exerting element 15 acts on that end edge of the support surface 4 that is directed toward it and serves as a stripping edge 36 for staples, possibly with the rest of the sheet material of the processed stack being clamped in between.

Figure 9:
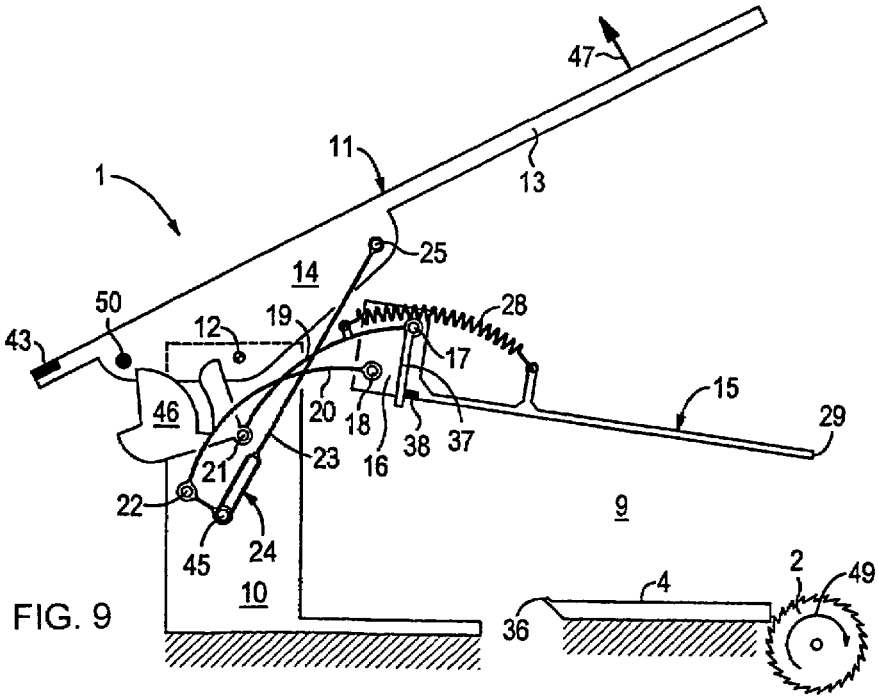
FIGS. 9 to 13 are sectional views of yet further-open positions of the closure cover analogous to FIG. 6 up to the maximum open position in FIG. 13, in the case of which the support for a new sheet-material stack and the feed shaft for the sheet-material stack are completely empty.

That end of the control link 19 which is directed toward the pressure-exerting element 15 projects beyond its pivot pin 17, which is positioned there, in order to form a carry-along stop 37, which projects at an angle in the direction of the abutment surface 4. In the case of the pressure-exerting-element-side pivot pin 18 of the displacement link 20 being located above the framework-side pivot bearing 21 of the control link 19 and in the case of the closure element 11 being pivoted open in part (FIGS. 9 and 10), with the pressure-exerting-element-side pivot bearing 17 of the control link 19 being positioned at a correspondingly high level, in order to be pivoted along, the carry-along stop 37 strikes against a mating stop 38 which is mounted on the pressure-exerting element 15 in the region of the articulation carrier 16. As the closure element 11 pivots open 47 further, the carry-along stop 37 transmits the resulting torque in order to raise the pressure-exerting element 15 further in the direction away from the support surface 4 (FIG. 9). This applies as far as the raised rotary position of the closure element 11 according to FIG. 10. The rest of the upward pivoting movement of the pressure-exerting element (FIGS. 11 and 12) as far as the extreme open position according to FIG. 13 takes place via a control curve 39 of a control arm 46, which extends the control link 19, by way of the guide protrusion 50, beyond its pivot pin 21 on the bearing base and is configured as a two-armed lever which is active on both sides of the pivot pin 21.

At its end that is directed away from the pressure-exerting element 15, the control link 19 thus has its control arm 46 extending beyond its pivot bearing 21 on the bearing base 10. Furthermore, at its end that is directed away from the pivot pin 21, the control arm 46 contains a shoulder surface 40 and an end stop surface 41, and these are located at an obtuse angle in relation to one another. In the case of the closure element 11 being pivoted open beyond the top of its pivoting path (FIG. 12), the end stop 43, which is disposed at the outer end of the closure element 11, comes into contact with the shoulder surface 41 of the control arm 46.

By virtue of this contact, the driving torque which is applied to the closure element 11 by the operator in the continued-opening direction 44, and is active in the counterclockwise direction about the pivot pin 12, is fully transmitted to the control arm 46 via the end stop 43 and is active on the control link 19 as a pivoting moment which is active in the counterclockwise direction about the pivot pin 21. The control link 19 thus forces the pressure-exerting element 15 in the counterclockwise direction, beyond its vertical top dead-center position (FIG. 12), into a position in which it is more or less parallel to the closure element 11, which has pivoted further outward in relation to the support chamber 9. This renders the support chamber 9 easily accessible from above for the introduction of a sheet stack 7.

Figure 12:
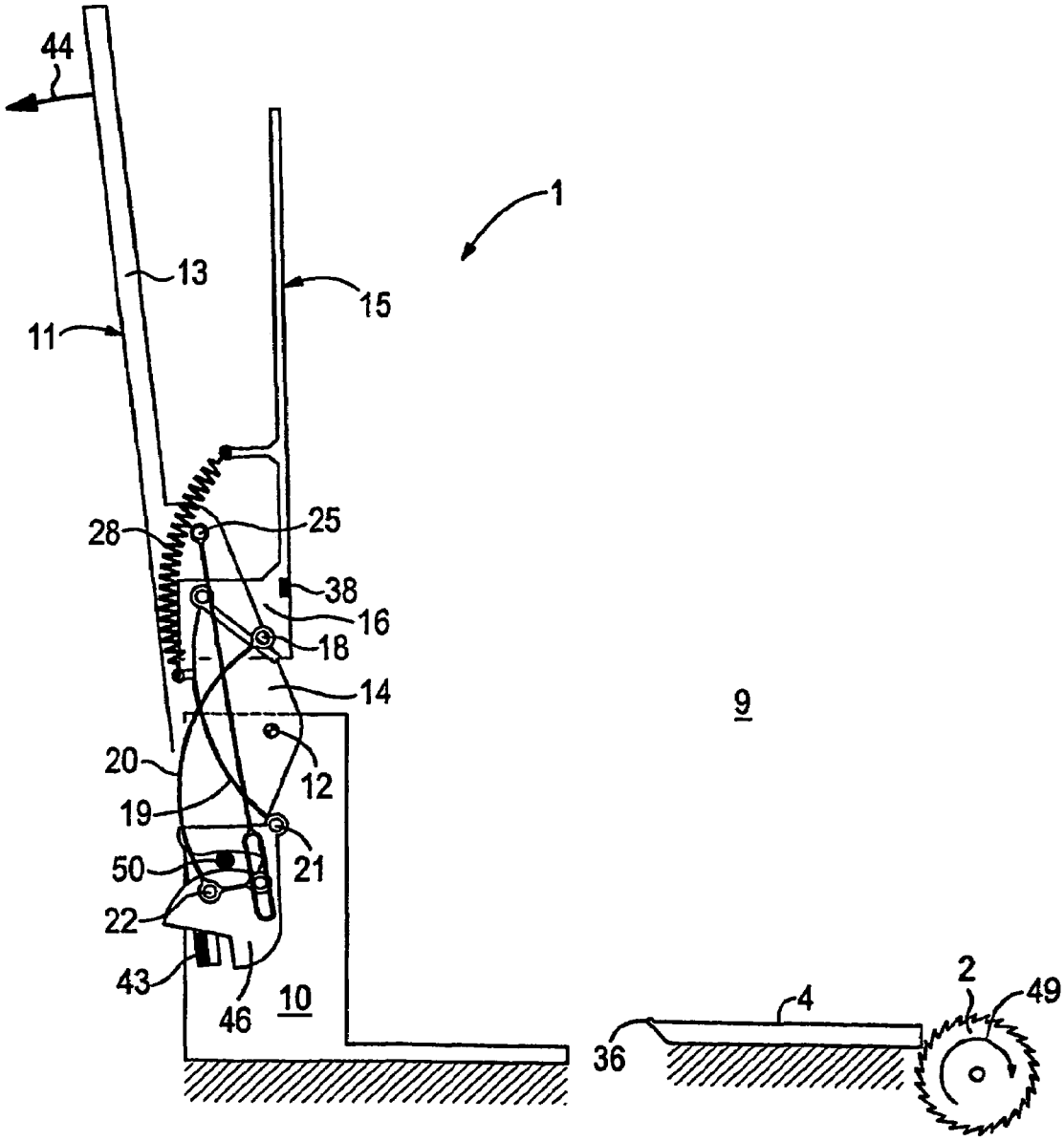
Figure 13:
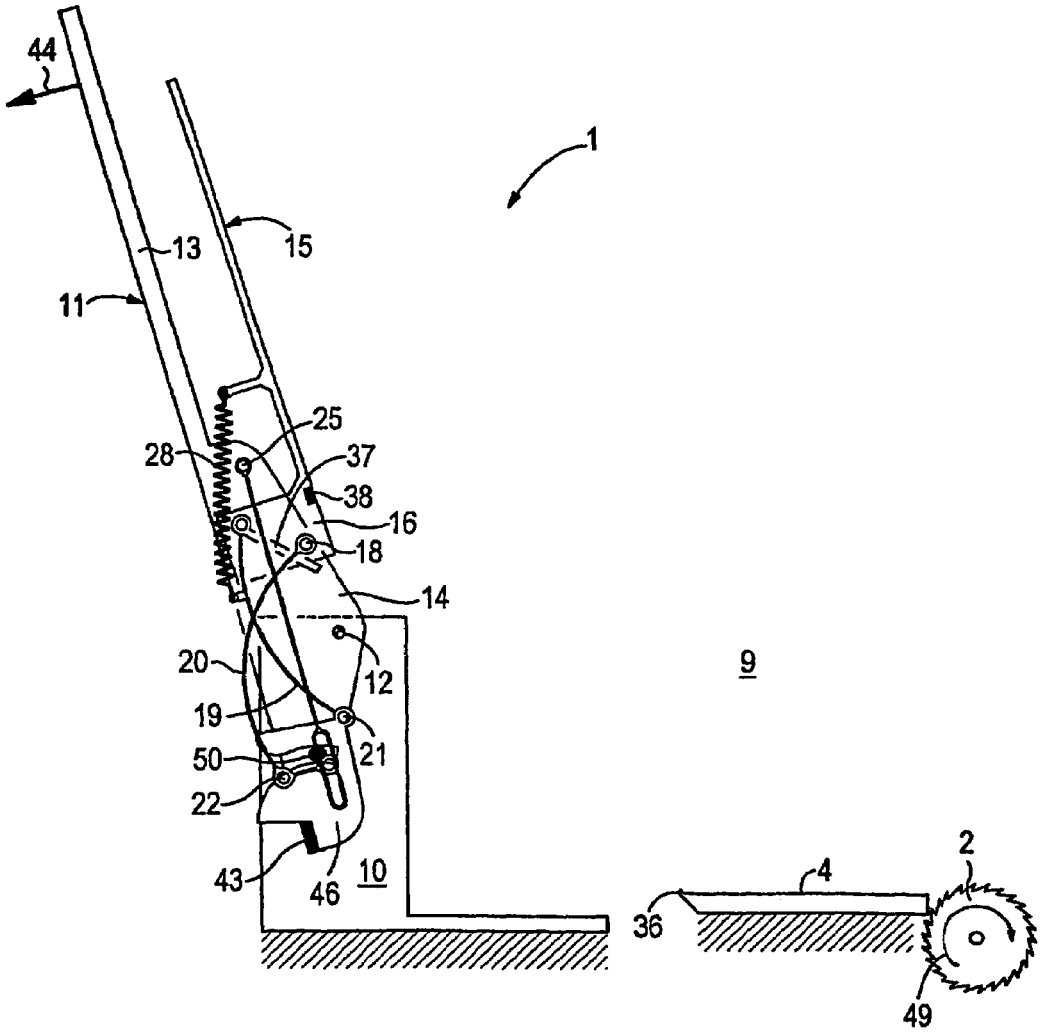
Figure 14:
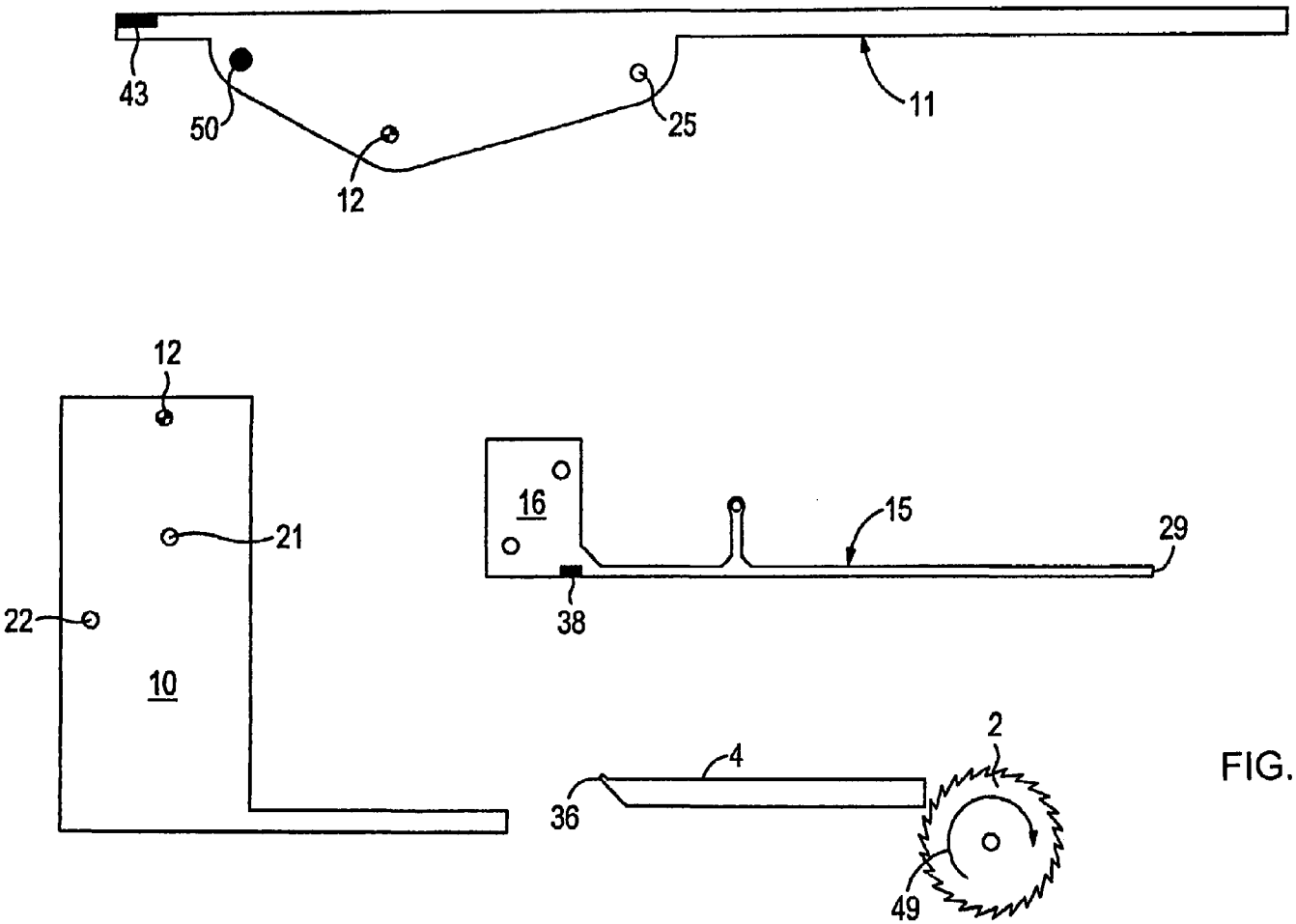
FIG. 14 is an exploded illustration showing, in separated form, the essential framework and operating parts of the apparatus according to the invention.
Figure 15:
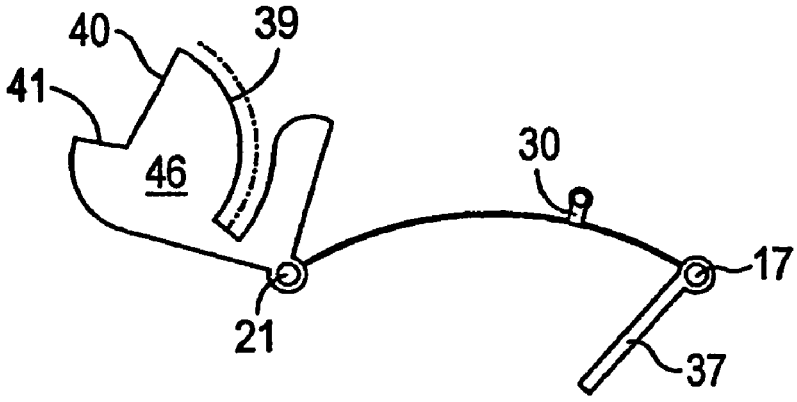
FIGS. 15 and 16 are illustrations showing the elements of the mechanism for securing the two pressure-exerting elements on their bearing bases.
Figure 16:
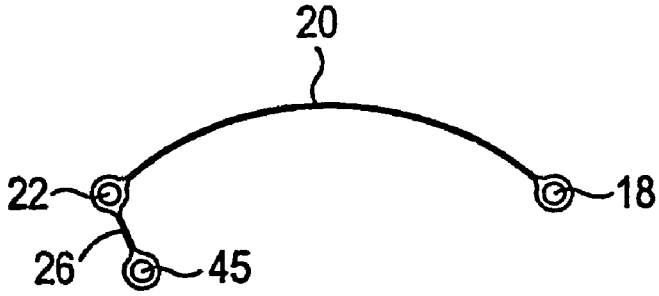
Figure 17:
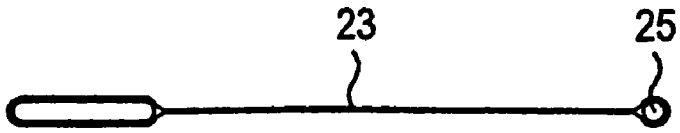
FIG. 17 is an illustration showing the connecting element that is intended for transmitting the pivoting drive power and is located between a closure element and the coupling mechanism for the pivoting control of a pressure-exerting element.

A description is given herein below of an operating cycle of the document destroyer in its individual steps, starting from the introduction position for the sheet stack 7 (FIG. 13), via the closure of the support chamber 9 by virtue of the closure elements 11 being pivoted closed (going back from FIG. 12 to FIG. 8 and then FIGS. 1 and 2) and via the subsequent processing of the sheet stack 7 in order to destroy it (FIGS. 1 to 5), until, finally, the closure element 11 is (or, even better, the two closure elements 11 are) pivoted open into the fully open position (FIG. 13).

The two closure elements 11 of the document destroyer interact correspondingly with one another in each case. Therefore, the pivoting-open movement of one of the closure elements 11 synchronously brings about an analogous pivoting-open movement of the other closure element 11 as well, by way of a non-illustrated synchronizing drive. A pulling connection between the two closure elements 11 ensures that the closure elements 11 are each positioned at an identical angle in relation to their pivot pins 12, even if the operator only pivots one of the two closure elements 11. This gives rise to the synchronized pivoting.

With the closure elements 11 and pressure-exerting elements 15 located in the extreme open position (FIG. 13), the sheet stack 7 is positioned in the support chamber 9 from above. The closure elements 11 then pivot from their upright open position into the essentially horizontal closed position (FIG. 1). The pivoting movement is executed synchronously, at the same pivoting angle in each case, by the two closure elements 11. The pressure-exerting elements 15 assigned to the two closure elements 11 are carried along here in the manner described. The closed position, which follows on from the loading operation, is illustrated in FIG. 1. In this case, the two pressure-exerting elements 15 have their projecting ends 29, which are inclined downward in the direction of the region of the through-opening 5, acting on the center of the sheet stack 7.

The drawing-off configuration, in the form of the two carry-along rollers 2, 3 rotating permanently in opposite directions, is then switched on. The sheet stack 7 is processed sheet by sheet from its underside 6, as is described in detail in International Patent Disclosure WO 01/54820 A1, which was mentioned in the introduction.

During the processing of the sheet stack 7, the rotary position of the two pressure-exerting elements 15 in relation to the sheet stack 7 changes in the manner illustrated in FIGS. 2 to 5. These figures merely illustrate the left-hand pressure-exerting element 15 and, as the sheet stack 7 is processed to an increasing extent, i.e. as its stack height 31, 33 decreases to zero, the pressure-exerting element is pivoted in the counterclockwise direction, with the result that, in the case of the stack height being zero (FIG. 5), the pressure-exerting element 15 acts to a pronounced extent on the stripping edge 36 of the support surface 4. At the beginning of the sheet-destroying operation with the stack height at a maximum, the pressure-exerting elements 15 have their projecting ends 29 acting in the center of the sheet stack 7 in the drawing-in region of the carry-along rollers 2, 3. This enhances the friction of the carry-along rollers 2, 3 with the facing surface of the bottom layer of the sheet stack 7 and, ultimately, gives rise to the desired center fold. In this initial state, the dead weight of the residual stack which bears on the bottom layer of the sheet in the region of the stripping edges 36 is sufficient to ensure that any adhering staples are stripped off.

However, the dead-weight action decreases along with the stack thickness 33, the reduction in the stack thickness increasing during the sheet-destroying operation. The resulting reduction between the bearing pressure to which the stripping edge 36 is subjected by the sheet-stack weight is substituted, as the residual-stack height 33 approaches a zero height, by the stripping edge 36 being subjected to external pressure from above by the pressure-exerting element 15. The pressure exertion is intensified and, in order to generate the desired stripping action, assisted by the pressure-exerting element 15 being pivoted in the counterclockwise direction (FIGS. 2 to 5). The pivoting takes place along with the pressure-exerting element 15 being lowered downward in the direction of the support surface 4. The lowering of the pressure-exerting element 15 is brought about by the dead weight of the latter, and the counterclockwise pivoting of the pressure-exerting element 15 that is illustrated in FIGS. 2 to 5 follows as a consequence of the four-bar mechanism. This results from a specifically different magnitude for the pivot point/articulation spacings of the four-bar chain. The tension spring eliminates any possible play in the articulations and braces the four-bar chain in such a manner that an additional force of the pressure-exerting element in the downward direction is produced.

Figure 5:
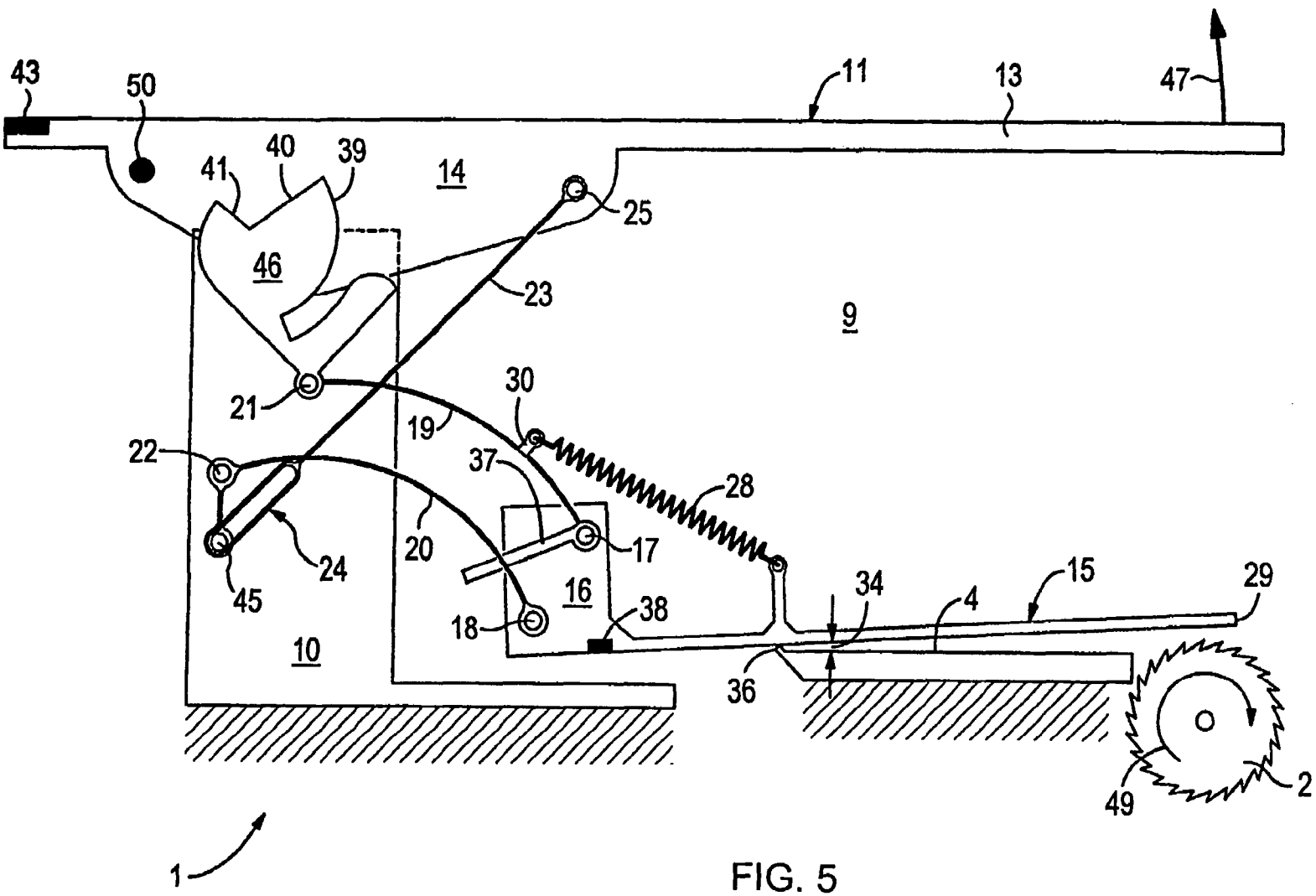
FIG. 5 is a sectional view analogous to FIGS. 2 to 4 once the final sheet of the original sheet stack (FIGS. 1 and 2) has been drawn off and destroyed.
Figure 6:
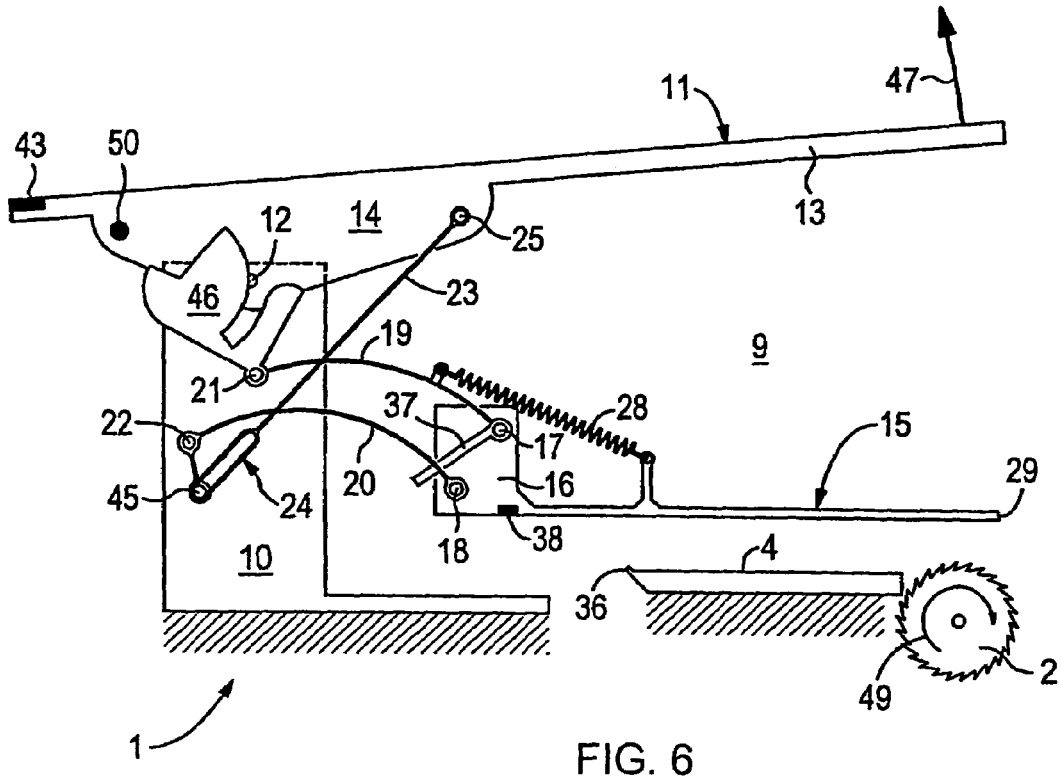
FIG. 6 is a sectional view analogous to FIGS. 2 to 5 in which the left-hand closure element—for the sake of simplicity also referred to herein below as "closure cover"—has been pivoted up by a few angular degrees from its closed position, which is illustrated in FIGS. 1 to 5, in the direction of its open position and raises the pressure-exerting element along with it.
Figure 7:
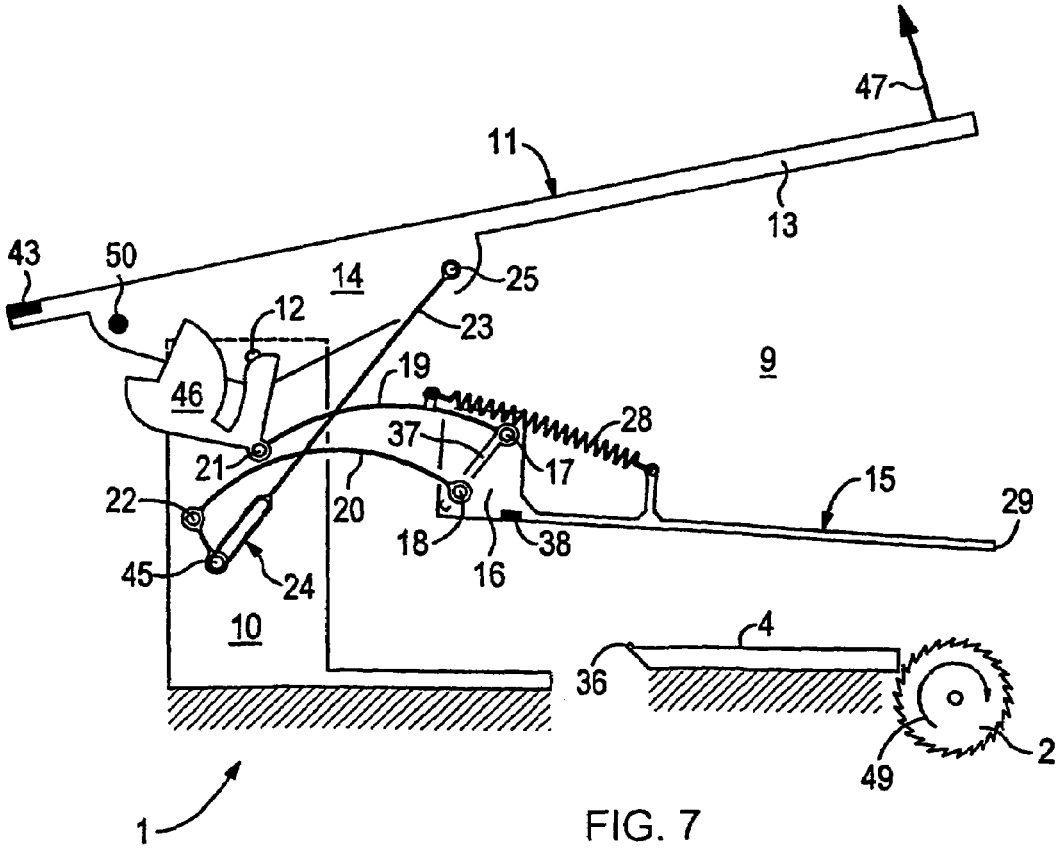
FIG. 7 is a sectional view analogous to FIG. 6 once the closure cover has been opened beyond a larger pivoting angle than FIG. 6, in which case it raises the pressure-exerting element further.
Figure 8:
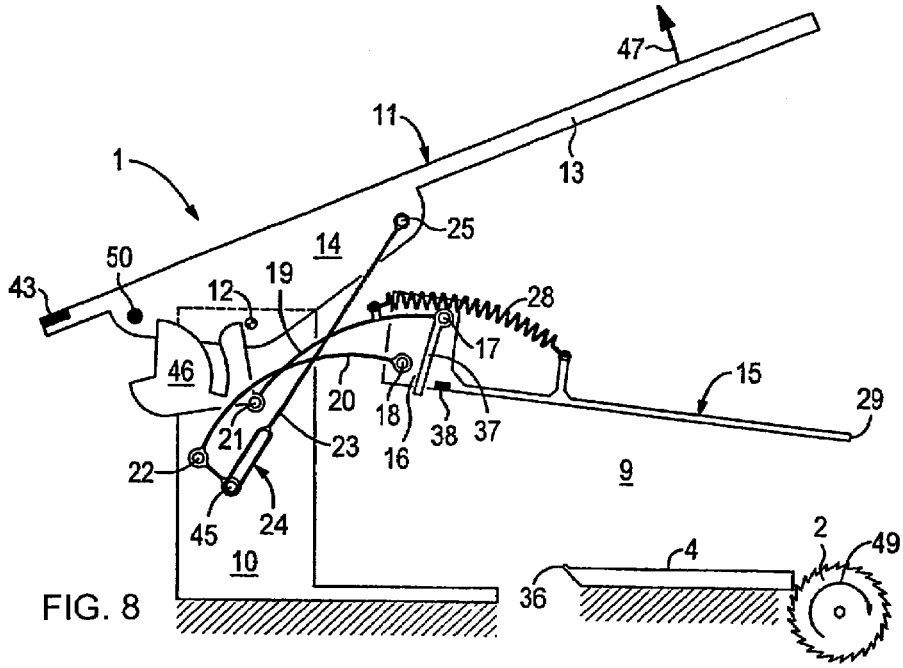
FIG. 8 is a sectional view showing a guide protrusion being positioned on a control arm, in particular on a control curve.

Once the sheet stack 7 has been fully processed or destroyed (FIG. 5), the covering extension arm 13 of the closure element 11 is pivoted open in the opening direction 47 (FIG. 5). The synchronous connection of the pivot mountings on both sides results in an analogous pivoting-open movement on the right-hand side with the closure element 11 there. The connecting link 23 is drawn upward by the pivoting-open movement in the opening direction 47.

The connecting link 23 pivots the extension spur 26 in the counterclockwise direction, in the region of its end articulation 45, about the pivot pin 22 on the bearing base 10. This pivoting drive causes the displacement link 20 to be pivoted up in a counterclockwise direction about the pivot pin 22. As a result, the pressure-exerting element 15 is raised upward from the support surface 4. The operation of the closure elements 11 being pivoted open in the opening direction 47 is transmitted to the pressure-exerting element 15, by the displacement link 20, as far as the displacement position that is illustrated in FIG. 9.

Figure 10:
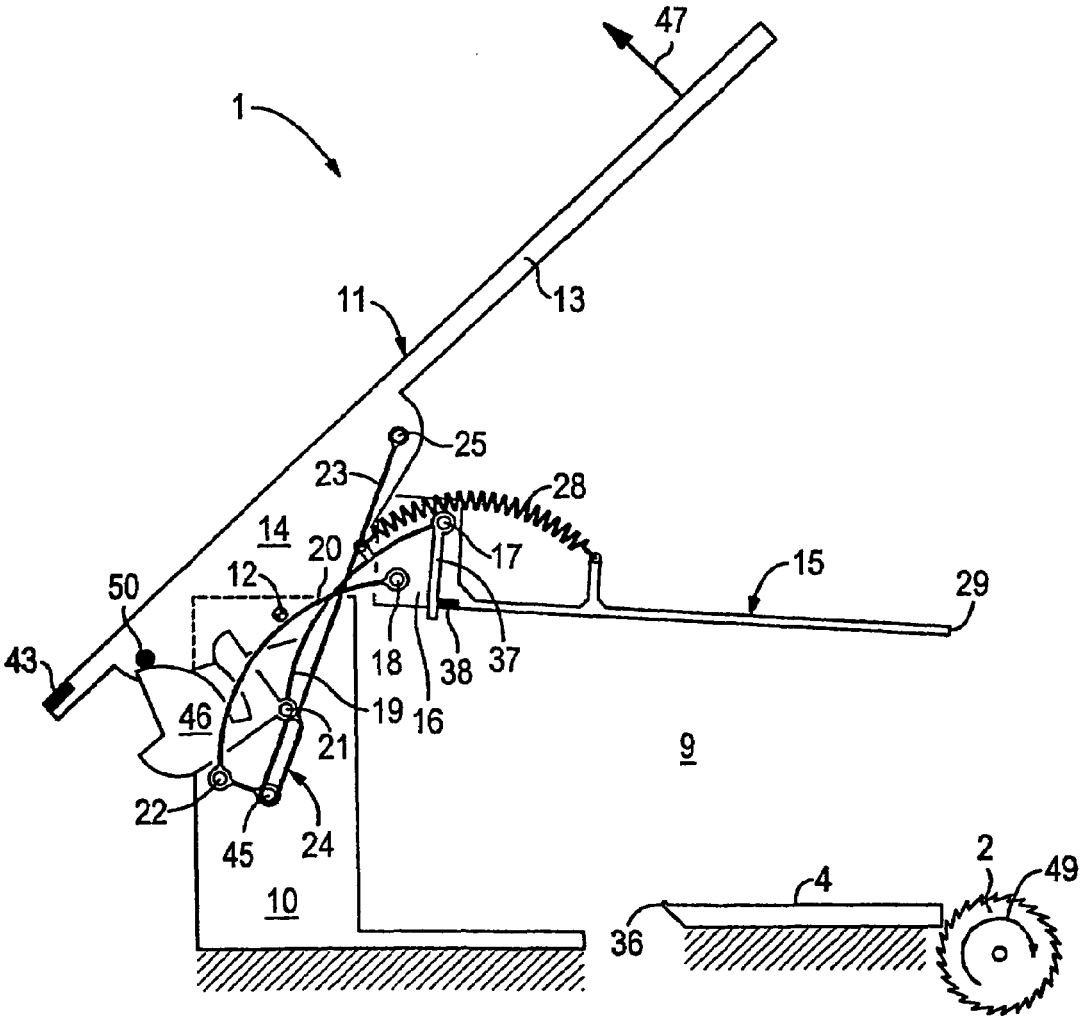
Figure 11:
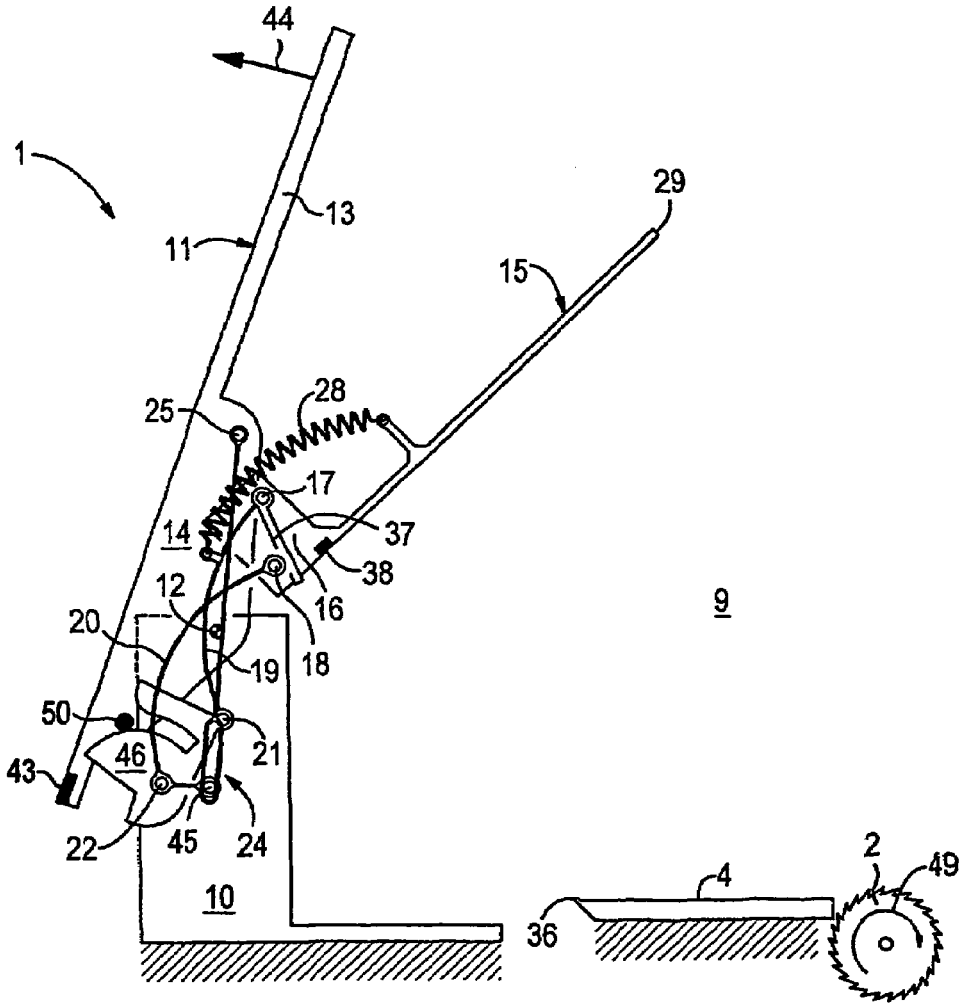

Beginning from the half-open rotary position reached by the closure elements 11 (FIG. 9), the guide protrusion 50, which is positioned at the rear end of the closure element 11, runs onto the control curve 39 of the control arm 46 (FIG. 10). Furthermore, the final pivoting of the two pressure-exerting elements 15 into their definitive open position (FIG. 13), which completely frees the access to the support surface formed from above and in which the elements are swung apart from one another in the upward direction in a cup-like manner, this final pivoting movement going beyond FIG. 9 and being illustrated in FIGS. 10 to 13, is brought about by the closure elements 11 being pivoted apart from one another in the opening direction 44. Starting from the partially open position of the closure elements 11, this position being illustrated for example in FIGS. 9 and 10, the rotary drive power which is produced by the closure elements 11 being pivoted apart from one another is transmitted from the control arm 46 to the control link 19, as the torque which is active in the counterclockwise direction about the pivot pin 21, by virtue of the guide protrusion 50, which is connected to the rear pivoting arm 51 of the closure element 11, sliding onto the control curve 39. By way of its end that is directed toward the support chamber 9 for the sheet stack 7, the control arm 19 thus raises the pressure-exerting element 15 in the opening direction 47 via the pivot pin 17. The rotary pivoting of the control link 19 about the pivot pin 21 is associated with the raising-action pivoting of the pressure-exerting-element end of the control link 19. The pivoting movement causes the pressure-exerting element 15 to pivot in the counterclockwise direction in the region of the articulation-carrier-side pivot pin 17 of the control link 19. The pivots open the projecting end 29 of the pressure-exerting element 15 counterclockwise in the opening direction 47. Starting from the closed position of the closure element 11 according to FIG. 5, the pivoting-open movement of the pressure-exerting element 15 lags behind the pivoting-open movement of the closure element 11 in the first instance, as far as a half-open position of the closure element 11 (FIGS. 9 and 10). The guide protrusion 50 then runs onto the control curve 39 of the control arm 46. As the closure element 11 pivots open further, the pressure-exerting element 15 then pivots at a higher speed of rotation than the closure element 11. The pressure-exerting element 15 regains, to a certain extent, the lost angled position in relation to the closure element 11 as far as the half-open position (FIGS. 9 and 10), until the extreme, swung-apart open position according to FIG. 13 is reached, the pressure-exerting element 15 being more or less parallel to the closure element 11 in this position.

During closure of the closure elements counter to the direction 47, the guide protrusion 50 moves in the opposite direction along the control curve 39 and thus allows the pressure-exerting element 15 to lead during the closing movement.

By virtue of two individual covers, this overall configuration also allows individual sheet feeding.

We claim:

1. An apparatus for destroying stacked sheet material substantially sheet by sheet, comprising:

a support surface for receiving a sheet stack, said support surface having a slot-shaped through-opening formed therein positioned approximately centrally in said support surface and intended for removing a sheet drawn off from an underside of the sheet stack;

a conveying configuration for drawing off the sheet material from said support surface and for feeding the sheet material to a cutting unit;

a support chamber for housing the sheet stack;

bearing bases flanking said support chamber on both sides of said slot-shaped through-opening;

closure elements having pivot pins pivotably mounting said closure elements on said bearing bases, said pivot pins disposed substantially parallel to a slot direction of said slot shaped through-opening and flank said support chamber on both sides, said closure elements covering said support chamber from above during a sheet-destroying operation and, for this purpose, said closure elements can each be pivoted, in a manner of covering halves, above said pivot pins, from an open position, in which said support chamber is open, into a closed position, in which said support chamber is substantially covered, and vice versa;

pressure-exerting elements positioned between said support surface and said closure elements and pressing the sheet stack against said support surface, each of said pressure-exerting elements being articulated on one of said bearing bases, in a manner of a connecting rod of a crank-rocker linkage;

displacement links each connected between a respective one of said pressure-exerting elements and a respective one of said bearing bases;

control links each connected between a respective one of said pressure-exerting elements and a respective one of said bearing bases; and articulation elements each being a connecting link acting on a respective one of said displacement links and connected to a respective one of said closure elements, such that, by virtue of said respective closure element being pivoted open or closed, said respective pressure-exerting element being pivoted along into a pressure-exerting position or open position corresponding to the open position of said respective closure element.

2. The apparatus according to claim 1, wherein said connecting link, which is active between said respective displacement link and said respective closure element, contains a rotary/pushing-action articulation.

3. The apparatus according to claim 2, wherein:

said displacements links each have a base-side articulation and an extension spur, and a pivoting connection between said respective connecting link and said respective displacement link acts on said extension spur of said respective displacement link, said extension spur functioning as a lever, projecting in a manner of a stub-like lever arm beyond said base-side articulation of said respective displacement link, and forming a two-armed lever with said respective displacement link.

4. The apparatus according to claim 2, wherein said rotary/pushing-action articulation has a pushing-action direction running in a longitudinal direction of said connecting link.

5. The apparatus according to claim 1, further comprising a feed shaft leading to said support surface and having side walls, said bearing bases being integrated in said side walls of said feed shaft.

6. The apparatus according to claim 1, wherein each of said displacement links and said control links, as far as said pressure-exerting elements are concerned, are articulated on that side of said respective pressure-exerting element that is directed toward a respective one of said bearing base.

7. The apparatus according to claim 6, wherein said pressure-exerting elements each have an articulation carrier with articulations, said articulation carrier disposed toward one of said bearing bases.

8. The apparatus according to claim 7, wherein said pressure-exerting elements each have a projecting end disposed away from said articulation carrier, and projecting as far as said slot-shaped through-opening.

9. The apparatus according to claim 8, wherein:

said conveying configuration has a pair of friction rollers acting on the underside of the sheet stack and circulating in opposite directions about axes which are disposed approximately parallel to a longitudinal direction of said slot-shaped through-opening; and said pressure exerting elements have a projecting length extending as far as a region of action of said friction rollers.

10. The apparatus according to claim 1, further comprising a tension-spring connected and acting between said respective control link and said respective pressure-exerting element and forces said respective pressure-exerting element upward in the opening direction, which is oriented away from said support surface.

11. The apparatus according to claim 10, wherein said respective control link has articulation ends and a fixing point for fixing said tension-spring positioned between said articulation ends.

12. The apparatus according to claim 1, wherein in a case of a large vertical spacing from said support surface or in a case of a large stack thickness, each of said pressure-exerting elements has a projecting end inclined in a direction of said slot-shaped through-opening of said support surface.

13. The apparatus according to claim 12, wherein a magnitude of an angle of inclination of said pressure-exerting elements declines in a case of a reduced vertical spacing or a reduced stack thickness.

14. The apparatus according to claim 12, wherein:

said support surface has an edge; and in a case of a small spacing from said support surface close to or equal to a stack thickness of zero, said pressure-exerting elements are inclined in a state in which said pressure-exerting elements slope up from said support surface in a direction of said slot-shaped through-opening, such that said projecting end of said pressure-exerting elements exerts pressure not on the sheet stack, but on said edge of said support surface.

15. The apparatus according to claim 14, wherein said edge of said support surface is a staple-stripping edge, and said respective pressure-exerting element acts on said staple-stripping edge of said support surface, with an interposition of a rest of the sheet stack.

16. The apparatus according to claim 1, wherein:

said respective pressure-exerting element has a mating stop;

said respective displacement link has a pivot bearing; and said respective control link has an end directed toward said respective pressure-exerting element and a pivot point, said end of said respective control link projects beyond said pivot pin of said respective control link positioned there, said end being angled to form a carry-along stop, said carry-along stop projecting in a direction of said support surface and, in a case of said pivot pin of said control link being positioned above said pivot bearing of said displacement link and in a case of said respective closure element being pivoted open in part, strikes against said mating stop of the respective pressure-exerting element and, with continued abutment, raises said respective pressure-exerting element in a direction away from said support surface.

17. The apparatus according to claim 1, wherein:

said bearing bases each have a pivot bearing; and said respective control link has an end which is directed away from said respective pressure-exerting element, at said end, said respective control link projects beyond said pivot bearing of said respective bearing base by way of a control curve, said respective bearing base forming a two-armed lever with said respective control link and in a case of said respective closure element finally pivoting into the open position, transmits a rotary drive power from a manually pivoted respective closure element to said respective pressure-exerting element and pivots said respective pressure-exerting element into a definitive raised position.

* * * * *